US010720024B1

(12) United States Patent
Williams et al.

(10) Patent No.: US 10,720,024 B1
(45) Date of Patent: Jul. 21, 2020

(54) COMBINATION WAGER, USER INTERFACE FOR PARIMUTUEL SPORTS WAGERING DEVICES

(71) Applicant: BetMIX, LLC, Hunt Valley, MD (US)

(72) Inventors: David C. Williams, Nicholasville, KY (US); Calvin J. Martin, Newport, VA (US)

(73) Assignee: BetMIX, LLC, Hunt Valley, MD (US)

( * ) Notice: Subject to any disclaimer, the term of this patent is extended or adjusted under 35 U.S.C. 154(b) by 0 days.

(21) Appl. No.: 16/527,944

(22) Filed: Jul. 31, 2019

(51) Int. Cl.
*A63F 9/24* (2006.01)
*G07F 17/32* (2006.01)

(52) U.S. Cl.
CPC ..... *G07F 17/3288* (2013.01); *G07F 17/323* (2013.01); *G07F 17/3211* (2013.01); *G07F 17/3258* (2013.01); *G07F 17/3272* (2013.01)

(58) Field of Classification Search
CPC ..... G07F 17/3288; G07F 17/3211; G07F 17/3258; G07F 17/3272; G07F 17/323
See application file for complete search history.

(56) References Cited

U.S. PATENT DOCUMENTS 2,179,698 A 11/1939 Levy et al.
2,182,875 A 12/1939 Levy
5,411,258 A 5/1995 Wilson
5,830,068 A 11/1998 Brenner et al.
5,846,132 A 12/1998 Junkin
6,358,150 B1 3/2002 Mir
6,383,074 B1 5/2002 Boggs
6,450,887 B1 9/2002 Mir
6,712,701 B1 * 3/2004 Boylan, III ..... G06Q 50/34 463/42
6,736,725 B2 5/2004 Burns
8,636,571 B2 1/2014 Miller
8,814,700 B2 8/2014 Vlazny et al.
9,047,737 B2 6/2015 Brooks
9,053,608 B2 6/2015 Brooks
9,437,078 B2 9/2016 Keech
9,443,392 B2 9/2016 Keech
9,747,748 B2 8/2017 Corckran
2004/0235542 A1 * 11/2004 Stronach ..... G06Q 30/06 463/6
2005/0116410 A1 * 6/2005 Vlazny ..... G07F 17/32 273/139
2010/0144428 A1 * 6/2010 Fontaine ..... G06Q 50/34 463/28

(Continued)

*Primary Examiner* — Steve Rowland
(74) *Attorney, Agent, or Firm* — Larry J. Guffey, Esq.; Oliver & Grimsley, LLC

(57) ABSTRACT

A user interface for the display of a parimutuel wagering device, that enables a player to place a combination wager on an upcoming contest, includes: (a) combination indicators that appear in the display, and wherein each of these represents one of the possible winning combinations of the wager, (b) value parameters that appear in the display, and wherein each of these is associated with one the combination indicators, (c) wherein each of the value parameters is a quantitative measure of the likelihood that a wager on its associated combination indicator will yield a return that is greater than the cost of the wager, and (d) wherein this value parameters is calculated from some of the temporally-updated information that is provided by the tote board that controls these parimutuel wagers.

20 Claims, 10 Drawing Sheets

| | | | | | |
|---|---|---|---|---|---|
| 7 | 5 | 7.70 | 61.16% | | 1.24 |
| 5 | 7 | 8.30 | 12.00% | | 1.00 |
| 7 | 3 | 9.70 | 10.90% | | 1.06 |
| 3 | 7 | 14.20 | 7.41% | | 1.05 |
| 5 | 3 | 15.80 | 4.24% | | 0.67 |
| 7 | 2 | 17.10 | 4.59% | | 0.78 |
| 3 | 5 | 19.90 | 3.89% | | 0.77 |
| 7 | 1 | 21.50 | 3.39% | | 0.73 |
| 7 | 4 | 24.50 | 3.19% | | 0.78 |
| 7 | 8 | 27.40 | 2.29% | | 0.63 |
| 5 | 2 | 31.10 | 1.79% | | 0.56 |
| 5 | 4 | 34.00 | 1.24% | | 0.42 |
| 2 | 7 | 35.10 | 2.83% | | 0.99 |
| 5 | 1 | 36.40 | 1.32% | | 0.48 |
| 7 | 6 | 44.70 | 1.67% | | 0.75 |
| 1 | 7 | 45.10 | 2.06% | | 0.93 |
| 2 | 5 | 48.50 | 1.48% | | 0.72 |
| 5 | 8 | 48.90 | 0.89% | | 0.44 |
| 3 | 2 | 58.90 | 1.10% | | 0.65 |
| 3 | 4 | 60.50 | 0.77% | | 0.47 |
| 3 | 1 | 61.20 | 0.82% | | 0.50 |
| 4 | 7 | 61.70 | 1.93% | | 1.19 |
| 4 | 5 | 61.80 | 1.01% | | 0.62 |
| 5 | 6 | 68.60 | 0.65% | | 0.45 |
| 1 | 5 | 70.40 | 1.08% | | 0.76 |

(56) References Cited

U.S. PATENT DOCUMENTS

| | | | | |
|---|---|---|---|---|
| 2012/0034961 | A1* | 2/2012 | Berman | G07F 17/3288 463/6 |
| 2013/0053991 | A1* | 2/2013 | Ferraro III | G06Q 50/34 700/93 |
| 2014/0302904 | A1* | 10/2014 | Cornett | G07F 17/3288 463/16 |
| 2015/0221170 | A1* | 8/2015 | Suzuki | G07F 17/326 463/25 |
| 2016/0260191 | A1* | 9/2016 | Emura | G06Q 50/34 |
| 2018/0047254 | A1* | 2/2018 | Acton | G06Q 50/34 |

* cited by examiner

RACE 6 EXACTA PROBABLES POOL TOTAL: $56,523

| WITH⊠ | 1 | 2 | 3 | 4 | 5 | 6 | 7 | 8 |
|---|---|---|---|---|---|---|---|---|
| 1 | - | 202.80 | 152.60 | 229.80 | 115.00 | 588.60 | 81.00 | 360.80 |
| 2 | 193.60 | - | 165.00 | 217.40 | 98.20 | 544.40 | 95.40 | 340.60 |
| 3 | 121.60 | 143.80 | - | 108.40 | 41.80 | 237.00 | 32.00 | 163.40 |
| 4 | 245.40 | 225.60 | 136.00 | - | 88.20 | 375.20 | 95.20 | 399.80 |
| 5 | 60.60 | 56.00 | 31.20 | 50.00 | - | 101.00 | 15.40 | 87.40 |
| 6 | 632.40 | 636.00 | 322.80 | 463.40 | 232.40 | - | 262.00 | 648.20 |
| 7 | 42.40 | 48.20 | 23.60 | 52.80 | 17.00 | 110.80 | - | 73.40 |
| 8 | 417.60 | 357.60 | 237.40 | 456.60 | 182.20 | 589.80 | 140.40 | - |

FIG. 1
(PRIOR ART)

EXACTA TOTEM

| 30 EXACTA | | 34 $1 WILL PAY | 36 PROB. | 38 BET | VALUE 40 |
|---|---|---|---|---|---|
| 7 | 5 | 7.70 | 61.16% | | 1.24 |
| 5 | 7 | 8.30 | 12.00% | | 1.00 |
| 7 | 3 | 9.70 | 10.90% | | 1.06 |
| 3 | 7 | 14.20 | 7.41% | | 1.05 |
| 5 | 3 | 15.80 | 4.24% | | 0.67 |
| 32 7 | 2 | 17.10 | 4.59% | | 0.78 |
| 3 | 5 | 19.90 | 3.89% | | 0.77 |
| 7 | 1 | 21.50 | 3.39% | | 0.73 |
| 7 | 4 | 24.50 | 3.19% | | 0.78 |
| 7 | 8 | 27.40 | 2.29% | | 0.63 |
| 5 | 2 | 31.10 | 1.79% | | 0.56 |
| 5 | 4 | 34.00 | 1.24% | | 0.42 |
| 2 | 7 | 35.10 | 2.83% | | 0.99 |
| 5 | 1 | 36.40 | 1.32% | | 0.48 |
| 7 | 6 | 44.70 | 1.67% | | 0.75 |
| 1 | 7 | 45.10 | 2.06% | | 0.93 |
| 2 | 5 | 48.50 | 1.48% | | 0.72 |
| 5 | 8 | 48.90 | 0.89% | | 0.44 |
| 3 | 2 | 58.90 | 1.10% | | 0.65 |
| 3 | 4 | 60.50 | 0.77% | | 0.47 |
| 3 | 1 | 61.20 | 0.82% | | 0.50 |
| 4 | 7 | 61.70 | 1.93% | | 1.19 |
| 4 | 5 | 61.80 | 1.01% | | 0.62 |
| 5 | 6 | 68.60 | 0.65% | | 0.45 |
| 1 | 5 | 70.40 | 1.08% | | 0.76 |

FIG. 7

30

EXACTA TOTEM

| EXACTA | | $1 WILL PAY | PROB. | BET | VALUE |
|---|---|---|---|---|---|
| 7 | 6 | 41.50 | 3.46% | | 1.44 |
| 5 | 6 | 26.10 | 5.42% | | 1.41 |
| 2 | 6 | 70.40 | 1.45% | | 1.02 |
| 3 | 6 | 8.50 | 11.68% | | 0.99 |
| 4 | 6 | 14.80 | 6.70% | | 0.99 |
| 6 | 5 | 9.80 | 10.05% | | 0.98 |
| 6 | 3 | 4.60 | 19.49% | | 0.90 |
| 6 | 7 | 13.30 | 6.64% | | 0.88 |
| 5 | 3 | 42.50 | 1.97% | | 0.84 |
| 7 | 3 | 64.40 | 1.25% | | 0.81 |
| 3 | 7 | 51.90 | 1.44% | | 0.75 |
| 6 | 4 | 5.80 | 12.14% | | 0.70 |
| 5 | 4 | 55.00 | 1.22% | | 0.67 |
| 3 | 5 | 29.30 | 2.18% | | 0.64 |
| 4 | 5 | 48.30 | 1.25% | | 0.60 |
| 7 | 5 | 89.00 | 0.65% | | 0.58 |

34 36 40

DELAWARE PARK

RACE: 4 8.3 F DIRT Mdn_Claimer RACING!

MAIDEN CLAIMING. PURSE $13,000 (PLUS UP TO 50% OTHER SOURCES) FOR MAIDENS; THREE YEAR...

44 42

| P# | HORSE NAME | ML ODDS | OFF ODDS | ODDS% | WIN POOL | R |
|---|---|---|---|---|---|---|
| 6 | TAZMONIAN DEVIL | 8.0 | 0.60 | 62.5 | $19,046 | 1 |
| 3 | ALONG CAME MIZZY | 4.0 | 3.00 | 25.0 | $6,905 | 2 |
| 4 | AVANTE LIGHT | 2.0 | 6.00 | 14.3 | $4,301 | 3 |
| 5 | ERIN GO BRAUGH | 6.0 | 7.00 | 12.5 | $3,561 | 4 |
| 7 | RED ROMAN | 10.0 | 12.00 | 7.7 | $2,352 | 5 |
| 2 | STERLING CANYON | 8.0 | 29.00 | 3.3 | $1,022 | 6 |

PLACE BET | MY BETS | ODDS/PAYOUT CHART | FACTOR STATS | QUICK HAN

☒ BET $ 2.00

| | | | | |
|---|---|---|---|---|
| ☒ | 6 | 3 | $ 2.00 | EX |
| ☒ | 2 | 6 | $ 2.00 | EX |
| ☒ | 7 | 6 | $ 2.00 | EX |
| ☒ | 3 | 6 | $ 2.00 | EX |

46

A NUMBER OF COMBOS: 4 OF 30 (13.3%)

B WILL PAY RANGE: $4.60 - $70.40

C PROBABILITY COVERAGE (SELECTED): 36.1%

D AVERAGE VALUE (SELECTED): 1.09

FIG. 8

COMBINATION WAGER, USER INTERFACE FOR PARIMUTUEL SPORTS WAGERING DEVICES

BACKGROUND OF THE INVENTION

1. Field of the Invention

The present invention generally relates to online, amusement devices. More specifically, the invention is directed to improved user interfaces and online methods that provide for parimutuel, sports wagering on types of wagers that require a player to select more than a single competitor (i.e., a combination of competitors) in an upcoming contest.

2. Description of the Related Art

Parimutuel wagering is a betting system wherein all the amounts of money wagered by a group of players/system users on each of the possible outcomes of a contest (e.g., which horse from among a field of horses will win a specific horse race) are placed together in a pool. Taxes and the "house take" are removed (e.g., 14.25%) so as to yield a payoff amount that is shared among those players or system users who correctly picked the winner of the contest (i.e., winning players).

Thus, for the example of a horse race, how much one wins relative to one's own winning bet depends on the payoff amount and the sum of the amounts that the other winning users also wagered. From knowing how much has been wagered on each horse in the race and thus the total amount wagered at the time of one placing his or her bet, one can get an idea of how much one might win if the percentages of money being wagered on the different horses stay the same until the start of the race when no further bets are accepted and the winning odds for the various horses are then determined.

Consider a hypothetical race with eight horses/runners, numbered 1-8, and to where the amount of money bet in pari-mutuel wagering on each horse to win is as follows at the start of the race; with this information, the calculations for winning some multiple of one's original bet can be made as shown below:

| Runners | $ Wagered | Calculations | Multiple/Odds |
|---|---|---|---|
| 1 | $6,000 | $88,152/$6,000 | 14.69 |
| 2 | $14,000 | $88,152/$14,000 | 6.30 |
| 3 | $2,400 | $88,152/$2,400 | 36.73 |
| 4 | $11,000 | $88,152/$11,000 | 8.01 |
| 5 | $2,400 | $88,152/$2,400 | 4.01 |
| 6 | $9,400 | $88,152/$9,400 | 9.38 |
| 7 | $30,000 | $88,152/$30,000 | 2.94 |
| 8 | $8,000 | $88,152/$8,000 | 11.02 |
| Pool: | $102,800 | | |

Payout = Pool − Take = Pool − 0.1425 × Pool = 0.8575 × Pool = $88,152.00

If runner #4 were to win on a $1 wager, it pays $8 which would be a return of the player's dollar plus a profit of $7. We refer to this "odds" on the #4 outcome as being 7-to-1. These "odds" are made available to potential players by a specialized machine that is known as a tote board, totalizator or tote. It keeps track of all the bets that have been made on a particular race, instantaneously computes the sum of the bets made on any one of the possible outcomes, does the necessary calculations to compute the "odds" on each horse, and then displays this information on various displays, including a large, tote board at the track and on various monitors at the track and others that are located away from the track at satellite wagering locations, and also on numerous mobile devices that are running wagering applications that are given access to the tote board's calculated "odds," etc.

Using the information that is posted and continually updated on the tote board, one is able to know, when placing one's bet, the various odds, depending on which outcome one bets, for winning some multiple of one's original bet—these odds often impact the wager that a player or system user will make and therefore add to the excitement of such wagering games.

Parimutuel betting differs from "fixed-odds" betting in that the final payout is not determined until the pool is closed—in "fixed-odds" betting, the odds are often being offered by a bookmaker who is responsible for making the required payouts to the winning users from the monies that the bookmaker presumably collects from those users who placed non-winning bets on the same race with the bookmaker. If these monies are insufficient to make the required wining payouts, the bookmaker is expected to make up the balance of any needed funds from the bookmaker's own surplus funds.

Parimutuel wagering is usually state-regulated by the establishment of a body of rules by which those entities who provide parimutuel wagering must operate. Thus, parimutuel wagering is offered in many places where "fixed-odds" betting or gambling is otherwise illegal. The state regulatory agencies for parimutuel wagering usually belong to the Association of Racing Commissioners International (ARCI), which is their rule-making, umbrella organization in North America and parts of the Caribbean for parimutuel wagering on professional horse and greyhound racing.

From its beginnings in the 1930's, parimutuel wagering evolved as part of the larger wagering, entertainment industry by developing a wide assortment of innovations, including: (1) cash-accepting, wagering terminals or machines, (2) self-service wagering machines, (3) advanced deposit wagering—first using the telephone and eventually using the internet and online mobile devices, (4) interstate simulcast wagering in the late 1970's, (5) intrastate simulcast wagering in the early 1980's, and (6) new types of wagering opportunities, including wagering on previously-run, order of finish contests as part of what has become known as "instant wagering" or "instant racing," or, for the horse racing industry, "historic horse racing" (HHR).

Online, pari-mutuel, mobile wagering involves a player signing up and establishing a player's secure account on one of the many websites that provide online, sports wagering (e.g., see Xpressbet.com) by completing the website's registration process and making an initial deposit to fund the player's account. A player is then provided with the pertinent data that is relevant to an upcoming race (e.g., identity of the horses and the jockeys in the race, appropriate background information on them, current racetrack conditions, the tote board's listed odds on any one of the various horses actually winning the race) at any one of a multitude of racetracks.

The information relevant to an upcoming race is provided so as to aid the player in deciding which horse in the field the player thinks will finish in any specific position at the end of the race (i.e., handicapping the race). There also exists various types of software that will assist a player in handicapping the races on which the player is considering placing a wager (e.g., see Betmix.com).

After a player handicaps a race, he or she then places his or her wager or wagers that the outcome of a designated race will be one or more selected horses finishing in one or more order-of-finish places. Depending on the video capability of a player's mobile device, the player can watch the race live or on a video replay to see which horse or horses finish in specific order-of-finish places.

Online, pari-mutuel, sports wagering is a mature technology and industry that has been around since early in the history of mobile devices and has seen many of the methods, systems and software associated with it be patent protected; see, e.g., U.S. Pat. Nos. 2,182,875, 2,179,698, 5,411,258, 5,830,068, 5,846,132, 6,383,074, 6, 358,150, 6,450,887, 6,736,725, 8,636,571, 8,814,700, 9,047,737, 9,053,608, 9,437,078, 9,443,392 and 9,747,748.

Despite the mature nature of online, pari-mutuel, sports wagering, there still exists the need and opportunity to further improve it. One area in which such improvements are needed is for technology that will reduce the huge learning curve that a novice player must master before he or she can actually increase his or her chances of being able to predict the winner of an upcoming event or race. For example, to wager wisely on horse racing, one needs to know many things, including: (a) a huge amount of background information on the horses and their jockeys and how to wisely use it to try to predict the winner of an upcoming race (referred to herein as handicapping a race), (b) what types of bets are available and which of these have the best odds of being winners considering the background information of the upcoming race, and (c) what amounts for one's various wagers or bets has the greatest likelihood of allowing a player to make money on his or her wagers.

Even for very experienced players, there is still always the immense challenge of how to wisely use the background or handicapping information available to a player. Additionally, current mobile, parimutuel sports wagering platforms usually take, even for the most experienced players, an enormous amount of time to use which can greatly detract from one's actual wagering experience.

As an example of the wagering challenges that are presented to a player, consider the difficulties that one encounters if the player is in the situation where the player is confident about being able to pick the winner of an upcoming race, but the posted, tote board odds on the player's pick are such that the winning payout will be so small as to not make the wager of much interest, etc.

An alternative wager the player might consider making is a straight Exacta wager (i.e., one in which the player pick's the first place finisher to be the horse that he is confident will win and then also picks, as a part of the same wager, the second place finisher in this race) on the upcoming race. Why might this be an interesting wager to place in a race that has, for example, eight horses/competitors?

It could be an interesting wager because of the comparatively huge payoffs if the player can also correctly pick the second-place finisher. The odds for such an Exacta wager are usually shown on a track's tote board, and they can indeed show significant potential payouts.

FIG. 1 shows an example of such tote board odds for a straight Exacta wager in a field in which there are eight horses/competitors. The eight horses in the race results in the player being presented with the 8×8 matrix shown in FIG. 1.

It lists in a row, in its top line, the eight picks that a player has from which to pick the horse which the player believes is going to win the race (i.e., either horse #1 to horse #8). Once the player has picked his winner, the player then has only seven remaining horses from whom to pick the horse that will finish in second place. These are listed in order below the horse that the player picked to win the race and also for all the other horse that the player didn't pick to win the race so as to yield the 8×8 matrix shown in FIG. 1.

Given that a horse can't finish both first and second in the same race, there are only 8×7 or 56 various entries in the matrix for the combinations of 2 horse pick on which the player can place a straight Exacta wager in this race which will have eight competitors (i.e., 1-2, 1-3 . . . 8-7).

What the tote board image of FIG. 1 is showing, at a specific instant in time (recall that the numbers on the tote board are continually changing as more wagers are placed up until race time), in each one of its matrix's 56 entries is what the player's return or payout will be on a straight $2 Exacta wager. Thus, for example, the FIG. 1 matrix shows us that the entry for the 7-5 combination indicates that this combination of horse picks will pay $15.40 for a $2 straight Exacta wager or bet if the race ends with horse #7 finishing $1^{st}$ and horse #5 finishing $2^{nd}$.

But, does such odds information really tell us if this 7-5 combination pick is a wise wager? Unfortunately, no it doesn't, since the player still has many more things to consider before deciding to place the player's straight Exacta wager. For example, it the tote board also shows that the #5 horse's odds for winning the race are relatively good at 4-1, would this make the 7-5 pick a good choice if the player was confident that the #7 horse was going to win? Are there other picks for the second-place finisher that might make sense since some of them have such comparatively larger payouts (e.g., the 7-6 pick at $262 versus the 7-5 pick at $15.40)?

As noted before, even very experienced players are usually, still immensely challenged to pick the correct, two-horse combination for a straight Exacta wager even after considering all the information made available on a tote board. In fact, this problem, of not having enough time to adequately analyze the existing handicapping information for a race or even the data provided by the tote board, is especially acute for any type of wager in which the player is required to pick more than one horse/contestant for the player's wager.

As previously seen in FIG. 1, the tote board's matrix presentation for a wager requiring only two horse picks presents a potential player with information in a format that is likely to cause eye strain and, because the tote board's information changes about every 30 seconds, imposes on the player the requirement to analyze the information shown in a time period that is too short and which therefore makes this analysis task practically impossible.

Even if one could make some practical use of the information shown in FIG. 1 in determining how to pick the horses for a player's straight Exacta wager, the task of actually placing such an informed multi-contestant wager is usually not helped by the form of the current "bet screens" or user interfaces that are available for placing wagers in which the player must pick more than one contestant for a particular type of multi-contestant wager. See an example of a typical, bet screen for straight Exacta wagering shown in FIG. 2.

To place bets on single, 2-horse combination in this interface, the user would select the combination they wish to bet (e.g., 1/2), the amount they wish to bet ($2), and then hit the "Bet" button. Unfortunately, this interface offers very little information that can help a player to analyze his/her handicapping task. Additionally, this user interface is inefficient because it requires a player to repeat this identification multiple times if the player wishes to place bets of different amounts on several Exacta combinations. Such a time-consuming task and can result in input errors or even the inability to place a desired wager if the task is being attempted, as it usually is, just before the deadline for placing wagers.

Consequently, current mobile, parimutuel sports wagering systems have a need for improved, graphical user interfaces that enable a player to better use racing's available handicapping information for those types of wagers which require the player to pick more than a single competitor (e.g., Exacta, Trifecta, Daily Double, Pick 3 and Pick 4), i.e., Combination Wagers. A result of this "better use" would ideally result in improved bet screens or user interfaces, etc. that yield both: (a) significant technological improvements for the parimutuel, sports wagering industry, (b) an integration of such improved user interfaces into those practical applications applied to the parimutuel, sports wagering industry, and (c) for its players, a reduction in the amount of time and effort that they must devote to their handicapping efforts for a multi-contestant or combination wager, while still enabling the player to fully analyze and use the available race handicapping information, etc.

BRIEF DESCRIPTION OF THE DRAWINGS

FIG. 1 is an example of an 8×8 matrix which displays, in each of its entries, the tote board odds for a specific two-horse combination pick for a straight Exacta wager on a race in which there are eight horses/competitors and thus 56 distinct possible picks for the Exacta outcomes of such a race.

FIG. 7 is an example of a preferred embodiment of one of the new user interfaces of the present invention that is applicable for straight Exacta wagering.

FIG. 8 is another example of a preferred embodiment of one of the user interfaces of the present invention that is applicable for straight Exacta wagering.

DESCRIPTION OF THE PREFERRED EMBODIMENT

Figure 2:
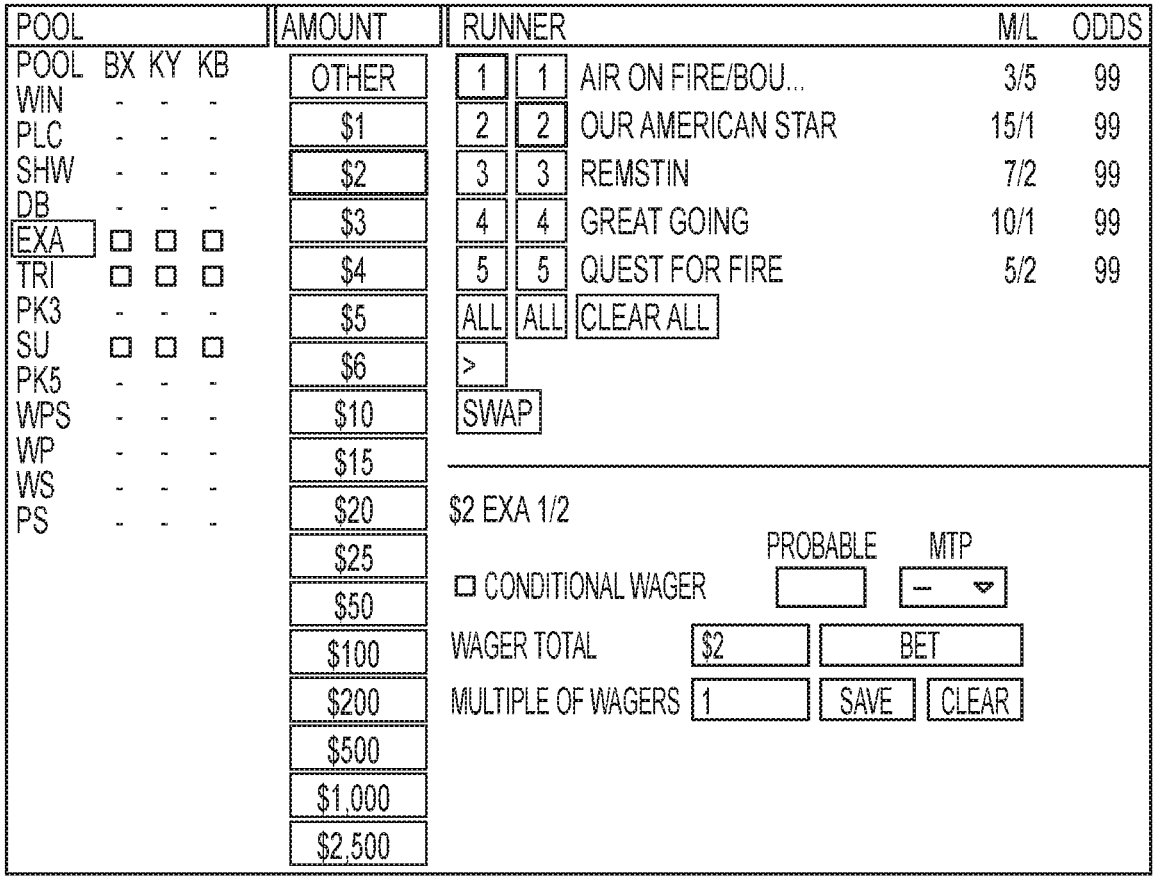
FIG. 2 (PRIOR ART)
FIG. 2 is an example of the current "bet screen" or user interface that is available for placing wagers in which the player must pick more than one contestant for a particular type of multi-contestant wager.

Before explaining at least one embodiment of the present invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

Figure 3:
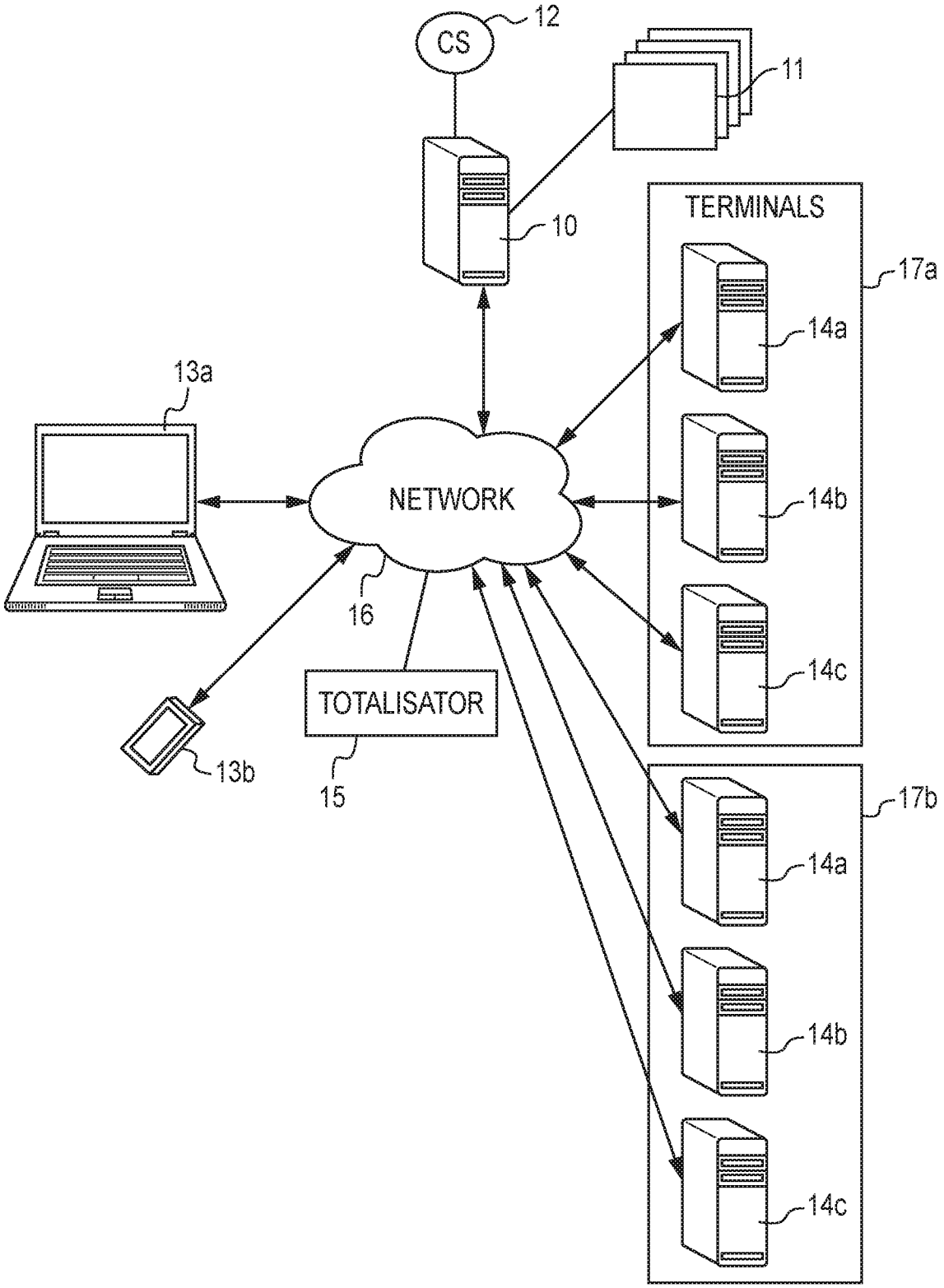
FIG. 3 is a block diagram that illustrates the general architecture of a sports wagering system that enables one or more players or users to make various types of wagers on any of a number of multi-contestant, order-of-finish contests (OOFCs) that may be occurring at any one of a multitude of locations or facilities.

Shown in FIG. 3 is a block diagram that illustrates the general architecture of a parimutuel, sports wagering system, according to the present invention, that enables one or more players or users to make various types of wagers on any of a number of races or multi-contestant, order-of-finish contests (OOFCs) that may be occurring at multiple locations or facilities. Such a system includes the server 10 of an entity that provides online, mobile, wagering and its database 11 and control software 12 that allows this server 10 and the mobile devices 13, terminals 14 and, a totalisator 15 with which the server communicates to, for pari-mutuel wagers, accept the players' various wagered amounts, etc.

To do this, the server of the present invention connects over a network 16 (e.g., the Internet or other network) to its targeted players who are those with mobile devices (laptop computer 13*a*, smart phone 13*b*, etc. with a touch-screen interface) and wish to place a wager via a web-browser-enabled 14*c* wagering terminal that is connected to a totalisator 15.

Also connected to this network are other players who are gathered to watch OOFCs and place wagers at a number of facilities (host 17*a*—where the actual OOFC is occurring, and guest 17*b*—an off-site location) via the facilities' various types of wagering terminals (e.g., teller 14*a*, self-service 14*b*, web-browser enabled (i.e., it connects & communicates over the network 16) 14*c*).

A totalisator or tote board is a key element of a parimutuel wagering system as it performs a wide assortment of key tasks, including: (a) receiving and validating each individual wager placed on a race or OOFC; totaling all the wagers into pools; continually computing and announcing or displaying to interested players the odds of each of the contestants winning a specific OOFC based on the sum of the wagers placed at each instant in time before the beginning of the OOFC; calculating, for pari-mutuel wagering, the payout of each wager based on the outcome of the contest; providing operational management of the receipt and payment for each wager placed; and tracking winning wagers and applying appropriate tax regulations to the winnings; (b) report and presentation generation: the storage of all the racing and wagering information, the selection, filtering and rendering of reports used in the conduct, operations, management and regulation of wagering, (c) operation of various tasks associated with a OOFC: entering and managing race-relevant, handicapping information for each contestant so that a player can view and consider this information before placing a wager; enabling & managing wagering for a particular OOFC; monitoring and controlling the terminals and other devices (e.g., video recording) at the host facility; and recording the outcomes of OOFCs; and (d) operational support services: configuring the underlying databases; monitoring all incoming and outgoing communication links, pool transfers, and information streams; configuring and managing the distributions applicable to each pool available for a wager on a particular OOFC, and monitoring and managing access to the totalisator by the facilities and players.

Figure 4:
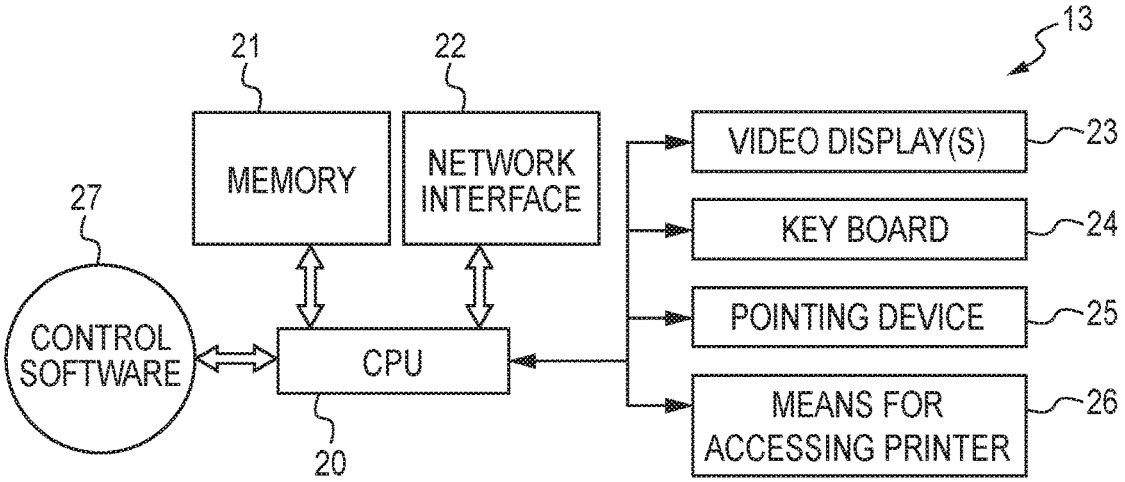
FIG. 4 is a block diagram that illustrates the general architecture of the types of mobile devices that are intended to be used with the present invention.

Some of the types of mobile devices that are intended to be used with the present invention include: an internet or network connectable, laptop computer 13*a*, a smart phone 13*b* or other smart device that may include: a CPU 20, memory 21, a network interface 22, video displays 23 for viewing by a player, a key board 24 and pointing device 25 to allow a player to interact with a web-browser enabled, terminal 14*c*, a means for accessing a printer 26 that allows a player to produce a hardcopy of any reports provided by the system, and control software that controls the functioning of the mobile device as it relates to its interactions with the server 10 of the present invention and the rest of this wagering system. See FIG. 4.

The mobile device's hardware and its control software assist in enabling a player or user to work with the server of the present invention to: (a) register to become a user of the present invention, (b) establish a player's account from which monies will be drawn to cover the cost of the various wagers placed by the player, (c) fund one's account through the use of one of the many forms of electronic fund transfers, whether bank account based or credit card based, (d) select, from among a multitude of races occurring at various race tracks around the world, one or more of such upcoming races on which to wager, (e) access and use information on various handicapping factors which can help a player better predict the outcome of the upcoming race, (f) place all manner of wagers on any or all of the available races, (g) select and receive a video stream of a selected race live or as a replay, and (h) conduct various administrative functions for the player's account.

The server's control software 11 is configured such that it facilitates all of the various functions and operations of the players' mobile devices while also keeping track of all of the register players and their accounts, plus all the information pertaining to upcoming races or OOFCs and the background data on the contestants participating in these OOFCs.

The present invention is ideally configured in such a manner as to build on and complement electronic payment technology, both today and into the future. Because of this commitment, its preferred embodiment is configured to run on a "cloud" server platform for maximum portability. The present invention requires that minimal local software be downloaded or installed. This approach simplifies the usually involved software application (app) certification process. The interface of the present invention is simply a website which its users visit. Local software is only used to enable access to local technology on the user device. The software of the present invention is configured so as to perform on Windows and Apple laptops using current browsers. Smartphone and tablet compatibility are also provided—Apple iOS, Android, and Windows are fully supported.

The software of the present invention is also configured so that its mobile interface operates with the look and feel of a local application, i.e., launched from an icon without starting the browser, even though it will run through the browser.

As a hybrid mobile application (i.e., cloud-based functionality which also incorporates native device utility), the present invention is further configured to access and utilize the local technology available on mobile devices, in particular cameras, near field communication (NFC) "swipe" sensors and readers.

To better acquaint one with the software requirements and capabilities of the present invention, shown in this application's FIGS. are various user interface screen illustrations or screenshots that the control software of the present invention makes appear on the display of a player's mobile device. These screenshots could be in a webpage or smart phone or tablet format, but are shown here in a smart phone format and in English. However, since the present invention is an international, multi-language, multi-currency invention, the native language environmental setting on each mobile device will be used to automatically select the language presented to the user. Date and currency formats will also match user preferences.

Figure 5A:
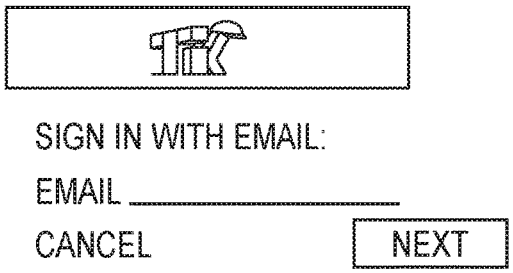
FIGS. 5A-5B show examples of some of the possible "login screens" and "account creation screens" that the present invention is configured to provide on the screen of the mobile device of a player that is using the present invention.
Figure 5B:
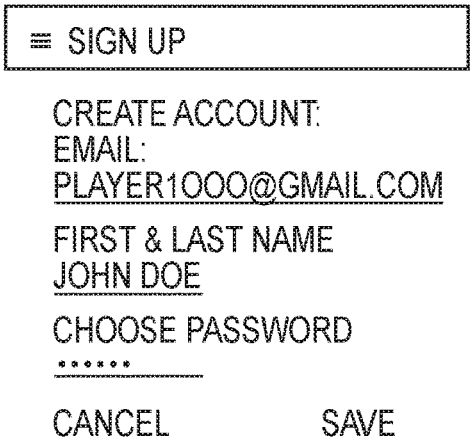

FIGS. 5A-5B show two examples of possible "login screens" and "account creation screens" for the present invention. These screens are configured so as to: (a) allow a player to register in order to gain access to use the present invention on the player's mobile device, and (b) setup a financial account that will provide from a financial institution of the player's choice the funds for the various wagers that a player elects to make.

Figure 6:
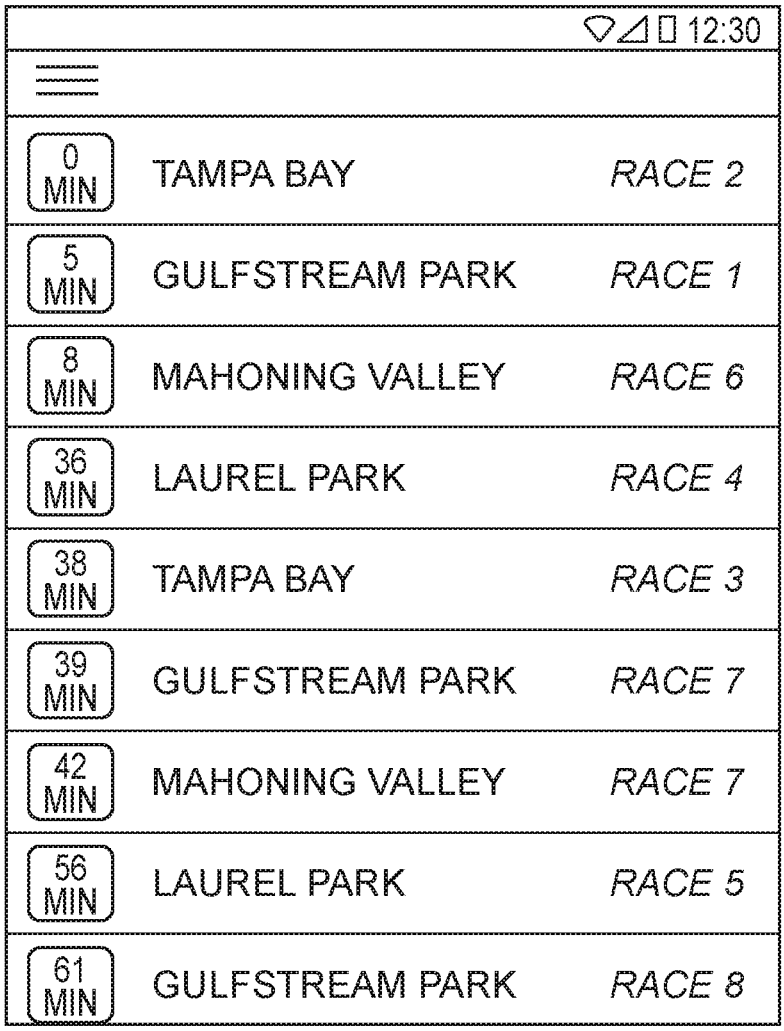
FIG. 6 an example of the type of screen shot that can be used by the present invention to display a list of all upcoming races which are soon to be held at any one of a number of multiple tracks with which the present invention is communicating, and on which a player can wager.

After these administrative requirements are completed, a player can begin the actual task of handicapping and placing wagers on upcoming races. The first step in this process will usually be to make a selection of the upcoming race on which the player wants to wager. To facilitate this selection, a screenshot similar to that shown in FIG. 6 will often appear on the mobile device of a player that utilizes the present invention. This screenshot was created by configuring the control software 12 that runs on the server 10 of the present invention so as to display a list of all upcoming races, which are soon to be held at any one of a number of multiple tracks with which the present invention is communicating, on which a player can wager. These are sorted in ascending order in this screenshot by the minutes until a race's post time (i.e., the time at which the contestants in the race are required to be at the starting post).

After now having described above the general architecture of the present invention and current mobile, parimutuel sports wagering platforms, we turn out attention to the problems previously mentioned of their inadequacies for allowing a player to wisely and intelligently place wagers of the type that require the player to pick more than a single competitor in an upcoming race.

As previously seen in FIG. 1, the tote board's typical matrix presentation of the odds data for all the possible two-horse-pick combinations for a straight Exacta wager on a race that has 8 starters, isn't very helpful.

In an attempt to provide, for current mobile, pari-mutuel sports wagering systems, improved, graphical user interfaces that better use racing's available handicapping information, the present invention makes the assumption that the handicapping information available to the players or bettors is being effectively and efficiently used by them to make their picks for the winners of the various upcoming races. The results of this assumption are then used to help a player make similarly wise picks for wagers of the type that require multiple picks for an upcoming race.

It follows, from this "effectively using handicapping information to pick winners" assumption, that the information which is displayed on a tote board, at any instant before an upcoming race, is a relatively accurate reflection of the sum of the wise handicapping efforts of the players who have elected to wager on the upcoming race.

If the tote board's display at any instant does indeed "reflect wise handicapping efforts," it may also be advisable to wait until as close to a race's start time as possible before placing one's wager. This "late wagering" strategy has the benefit of enabling a player to take advantage of the most recently posted and possibly also the most accurate handicapping information that will be available for a race. However, this "late wagering" strategy can also create a further challenge for a player by diminishing the time period which is available to the player for analyzing the handicapping information.

The present invention answers this challenge by creating various new user interfaces for a player's mobile device which recasts the information available on a tote board into a form which is more informative and thus easier for a player to use; especially in situations where the player's wager requires more than one pick (i.e., a combination of picks) from among the contestants in an upcoming race.

In this situation, a player would ideally like to have a quantitative measure 28 of the likelihood that the combination upon which a player is considering placing a wager will yield a return on the player's wager that is greater than the cost of the wager. The present invention creates such a quantitative measure and defines it in terms of the some of the information for the upcoming race that is provided by the applicable tote board.

Shown in FIG. 7 is an example of a preferred embodiment of one of the new "bet screen" user interfaces of the present invention that is applicable for straight Exacta wagering. It is referred to as an Exacta totem. It consists of a number of columns. The column or listing on the left side of FIG. 7 is entitled "Exacta" 30 and consists of the listing of each of the various possible, 56 two-horse Exacta combinations 32 or picks in an upcoming 8-horse race.

To the right of this "Exacta" column is a "Will Pay" 34 column that lists, for each of the respective 2-horse combinations, what the tote board currently indicates will be, assuming the 2-horse combination is a winning wager, the payout or "will pay" amount for a $1 straight Exacta wager.

To the right of this "Will Pay" column is a "Probability" 36 column that lists, for each of the respective 2-horse combinations, a calculated probability that the combination pick will be a winning pick. An example of the type of formula than can be used for calculating this probability is given below:

$$\text{Probability}=A\times B/(1-A)$$

Where:

A=the current probability of the player's selected $1^{st}$ place horse actually winning the race based on this $1^{st}$ place horse's portion of the win pool odds that are currently posted on the tote board (e.g., #4's odds are 4.0 and the sum of all the odds are 92, thus #4's probability is $4/92=4.3\%$), B=the current probability of the player's selected 2nd place horse actually winning the race based on this 2nd place horse's portion of the win pool odds that are currently posted on the tote board.

To the right of this "Probability" column is a "Bet or Bet Amount" 38 column that lists, for each of the respective 2-horse combinations, the total amount of the wagers or bets successfully placed on each combination.

To the right of this "Bet" column is a "Value" 40 column that lists, for each of the respective 2-horse combinations, the previously mentioned quantitative measure 28. This "Value" can also be considered to be an indicator as to whether the currently posted payout or "will pay" for a particular 2-horse combination pick is a good, fair or bad payout considering the invariably low probability of success that any 2-horse combination pick will have to overcome in order be a winning pick (e.g., is a payout of 30 times the wager adequate if there is less than a 2% chance that the two picked horses will actually finish $1^{st}$ and $2^{nd}$?).

An example of the type of formula than can be used for calculating this defined "Value" parameter 40 or quantitative measure 28, for each of the respective 2-horse combinations in a race, is given below:

$$\text{Value}=\text{"Will Pay"}\times\text{"Probability"}$$

Note that applying this formula to each of the respective 2-horse combinations in a race will yield a plurality of value parameters or a plurality of dynamic (in the sense of it continually changing its value over time as the information on the tote board changes in time) value parameters.

Using this definition for "Value," or a dynamic value parameter, 40 we say that a value of 1.0 is a "fair" payout for the odds that the 2-horse combination pick has of actually winning. Similarly, we say that a value of greater than 1 represents a comparatively good payout for the odds or probability that such a 2-horse combination pick will be a winning pick; or that a value of less than 1 represents a comparatively poor or bad payout for the odds or probability that such a 2-horse combination pick will be a winning pick.

Notice also that this totem lists in its "Exacta" column the various 2-horse combinations from top to bottom according to where each ranks in the "Will Pay" column with the combination paying the smallest multiple being placed at the top of the column. It should be noted that such a ranking is, according to the configuration of the present invention, an elective option of the player. For example, such a rank listing of the various 2-horse combination could also have been according to the "Value" parameter, and arranged such that the 2-horse combination having the highest "Value" parameter is placed at top of the column.

In general, what distinguishes the "bet screen" user interface shown in FIG. 7 for a type of wager that requires more than one pick (in this instance, the 2 horses for a straight Exacta) from the prior bet screens for the same type of wager is that the bet screen of the present invention contains a defined "Value" 40 parameter or quantitative measure 28 of the likelihood that the combination upon which a player is considering placing a wager will yield a return on the player's wager that is greater than the cost of the wager.

To further clarify the nature of the present invention, it should be noted that FIG. 7 can be described in a more general manner as disclosing a betting screen, user interface for the display of a computerized and network-connected, pari-mutuel wagering device (e.g., a desk-top or laptop computer, smart phone, etc. with a touch-screen interface). This user interface is especially configured so as to enable a player to place a wager of the type that requires a player to pick a combination of contestants in an upcoming contest which has a plurality of contestants. Since this invention is for parimutuel wagering, it uses a tote board to record all the wagers on an upcoming contest and then provides various types of information (e.g., odds, payouts) regarding these wagers.

This user interface can be described as having: (a) a plurality of combination indicators that appear in the parimutuel wagering device's display, and wherein each of them represents one of the possible winning combinations of a special type of wager, (b) a plurality of dynamic (in the sense of it continually changing its value over time) value parameters that also appear in the display, and wherein each of these is associated with one of the plurality of combination indicators, and wherein each of these dynamic value parameters is: (1) a quantitative measure of the likelihood that the combination with which the dynamic value parameter is associated will yield a return on the player's wager that is greater than the cost of the wager, and (2) calculated from some of the information provided by the applicable tote board.

Shown in FIG. 8 is another example of a preferred embodiment of one of the new "bet screen" user interfaces of the present invention that is applicable for straight Exacta wagering.

This user interface is described as having three parts or portions which consist of: (a) an Exacta totem on its left edge, (b) a summary portion or means 42 that displays, in the top, right part of the display, the tote board information 44 (e.g., for each contestant pertaining to their Win wagers: number, name, the odds set by the track for what it believes will be the tote odds when the race is called, the current tote odds, an odds percentage that is an implied probability percentage based on the live odds (e.g., odds of 2:1 yields 1/(Odds+1)=⅓=33%), the dollars currently in its Win wagers pool and where these dollars rank the contestant in terms of the various Win wager pools) for the Win wagers placed on each of the six contestants in the upcoming race, and (c) a summary of the Exacta wager or wagers a player is considering and analyzing 46 is located in the bottom, right side of the display, and wherein each of these Exacta wagers being considered and analyzed is highlighted in the Exacta totem. Also included in this display is a ouch activated "Place Bet" or wager button or means that enables a player to actually place a wager on one or more selected combination indicators from among the plurality of combination indicators.

Figure 9:
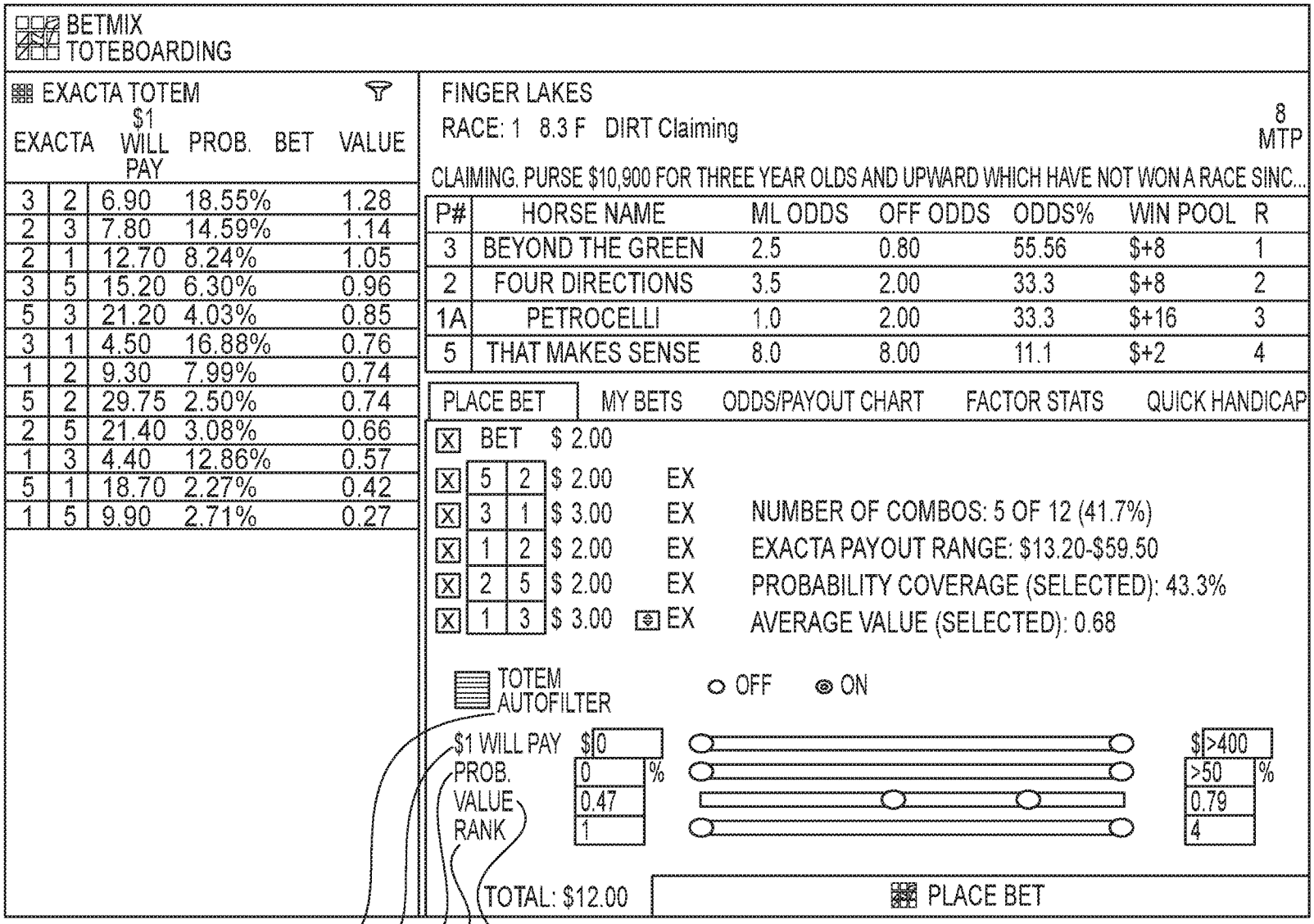
FIG. 9 is yet another example of a preferred embodiment of one of the new user interfaces of the present invention that is applicable for straight Exacta wagering.

Shown in FIG. 9 is yet another example of a preferred embodiment of one of the new "bet screen" user interfaces of the present invention that is applicable for straight Exacta wagering. This version differs from that shown in FIG. 8 in that it also shows in the bottom right part of this display a touch activated, filtering mechanism/tool or means 50 that is configured to enable a player help identify specific combinations upon which the player may want to place a straight Exacta wager based upon the numerical values of the previously introduced factors (e.g., "Will Pay," Probability, Value) for analyzing a potential Exacta wager, and the rank 52 that one of the individual contestants in a possible combination must have. In this example, the filtering mechanism are seen to be set for the following numerical ranges: Will Pay=$0-$400, Probability=0%-50%, Value=0.47-0.79, and Rank=1-4. The Exacta totem shows that such filtering yields five combinations for the upcoming 5 horse race that meet this criteria and these are highlighted in the totem.

In addition to creating and introducing new "bet screen" user interfaces, the present invention also provides new analytical tools and methods 60 for analyzing the potential payouts of various type of wagers (e.g., a Win wager on a particular contestant versus a straight Exacta wager on a combination of contestants). The present invention does this for horse racing by accessing and analyzing the huge databases of the results of previously run races.

The present invention begins this task by first searching the historical databases, of a specific track or group of tracks, to identify similar previous races. In this first example, we say that races are similar to that of an upcoming race if they: (a) were run over the same distance, (b) had the same number of contestants/competitors, (c) were run on the same surface, (d) were of the same class (maiden race or non-maiden race) and (e) were contested on same track. We say that such races "physically" similar.

Having found a large number of such previous races, we then compute certain relevant statistics for the results of these races that give one an assessment of the likelihood of a certain result in a population of upcoming races having similar conditions. For example, we compute: (1) the percentage of time that the betting favorite actually won the race 62, or finished in the top two places (placed) 64 or finished in the top three places (showed) 66, (2) the similar percentages of the other contestants in terms of what rank they were in the ranking of the betting favorites, (3) the return on investment (ROI) that player would have made had he/she placed a $2 wager on the #1 ranked favorite in each of the identified, previous similar races 68, (4) the similar ROIs that player would have made had he/she placed a $2 wager on each of the other ranked $2^{nd}$ to last ranked favorite in each of the identified previous similar races, (5) the percentages of time that the winning horse returned a payout in specific dollar ranges 70, and (6) the percentages of time that the winning, straight Exacta wager returned a payout in specific dollar ranges 72.

Figure 10:
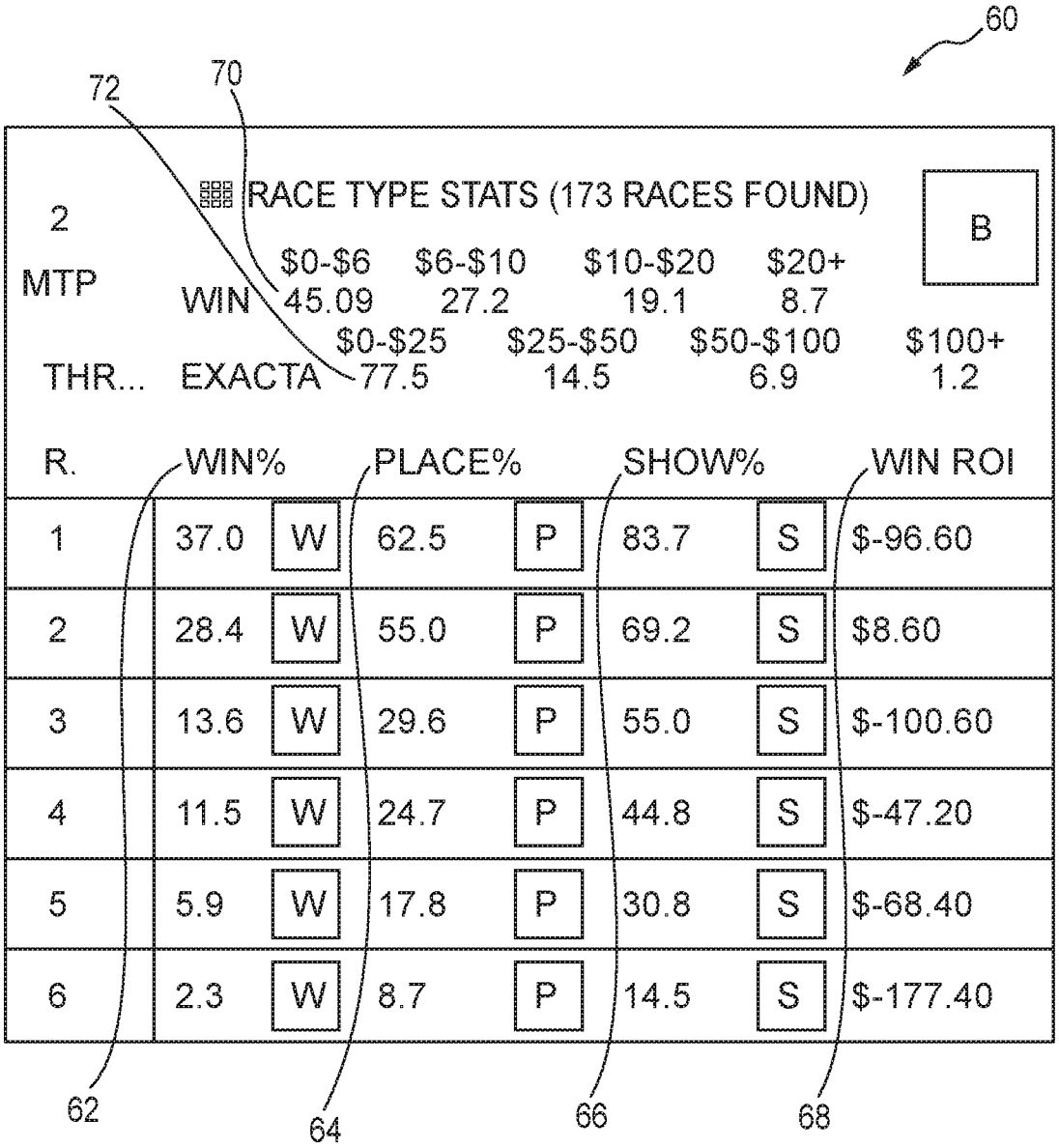
FIG. 10 is an example of the analytical results that the present invention can provide to help a player assess the likely usefulness of the handicapping information shown on a tote board based on the statistics for the accuracy of such information in a large population of prior races held under physically similar conditions (i.e., same distance, same number of contestants/competitors, same type of surface, same class and same track).

Shown in FIG. 10 is an example of the above described analysis. It show, for example, for the 173 analyzed previous, similar races that: (i) the betting favorite won 37% of the time, ran at least $2^{nd}$ 62.5% of the time and at least $3^{rd}$ 83.7% of the time, (ii) wagering $2 on the betting favorites in all of the previous, similar races would have yielded a ROI of a loss of $96.60, (iii) in 45% of these previous, similar races, the winning horse returned up to $6, and in 8.7% of such races, the winner paid $20 or over, and (iv) in 77.5% of these races, the straight Exacta paid under $25 for a $1 wager, and in 1.2% of them, the straight Exacta paid $100 or over. These results are also presented to a player in another of the present invention's new user interfaces.

The present invention also recognizes that there are different ways than that described above to define a "similar" previously run race. For example, "similar" previously run races can also be defined in terms of the pattern of the odds on the horses in races that have the same number of contestants. We then define such patterns by classifying the horses into various "odds" buckets that have differing range of odds. For this example, we define six buckets with respective odds ranges of: 0-<1, 1-2, >2-4.5, >4.5-8, >8-15 and >15-99.

If we are looking at an upcoming 8-horse race for which the current tote board posted odds on these various horses are 8:5, 2:1, 3:1, 7:1, 10:1, 14:1, 22:1, and 35:1, then using the above definition of our six buckets' odds ranges, we classify this upcoming race as one that has an odds pattern of 021122 (i.e., 0-<1:0, 1-2:2, >2-4.5:1, >4.5-8:1, >8-15:2 and >15-99:2), and we then search the database of previously races for those that have the same 021122 odds pattern distribution. Those that meet this criteria are said to have a similar odds pattern.

Figure 11:
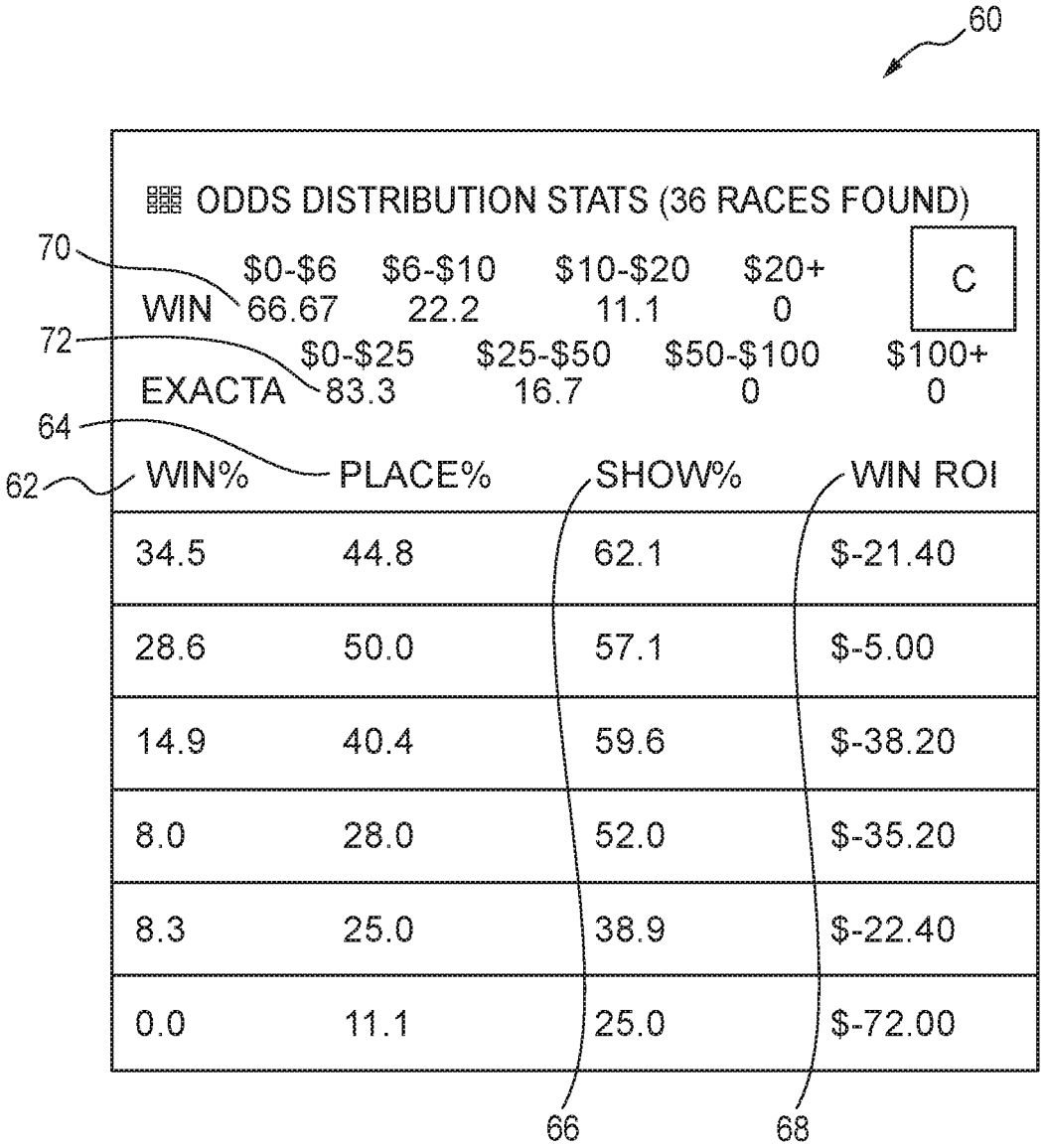
FIG. 11 is an example of the analytical results that the present invention can provide to help a player assess the likely usefulness of the handicapping information shown on a tote board based on the statistics for the accuracy of such information in a large population of prior races held under conditions in which the odds pattern distribution for the horses in the contest were the same, as was the number of horses.

Shown in FIG. 11 is an example of the above described analysis. It show for "odds pattern" similarity, for the same upcoming race our historical database was searched to yield the results shown in FIG. 10, we now find only 36 previous, similar races for which: (i) the betting favorite won 34.5% of the time, ran at least $2^{nd}$ 44.8% of the time and at least $3^{rd}$ 62.1% of the time, (ii) wagering $2 on the betting favorites in all of these 36 previous, similar races would have yielded a ROI of a loss of $21.40, (iii) in 66% of these previous, similar races, the winning horse returned up to $6, and in 0% of such races, the winner paid $20 or over, and (iv) in 83.3% of these races, the straight Exacta paid under $25 for a $1 wager, and in 0% of them, the straight Exacta paid $100 or over. These results are also presented to a player in another of the present invention's new user interfaces.

It can be noted that the odds pattern for an upcoming race will often constantly change up until race time, whereas the physically similar races don't have such a dynamic component.

The foregoing is considered as illustrative only of the principles of the present invention. Further, since numerous modifications and changes will readily occur to those skilled in the art, it is not desired to limit the invention to the exact construction and operation shown and described herein. Accordingly, all suitable modifications and equivalents may be resorted to, falling within the scope of the invention that is hereafter set forth in the claims to the invention.

We claim:

1. A user interface for the display of a parimutuel wagering device that enables a player to place a combination wager of the type that requires said player to pick a specified combination of contestants in an upcoming contest and where a tote board is used to record the wagers of all players who place one of said combination wagers on said upcoming contest and to provide temporally-updated information regarding said wagers, including "Will Pay" and "Probability" information, said user interface comprising:

a plurality of combination indicators that appear in said display, and wherein each of said plurality of combination indicators represents one of the possible winning combinations of said wager, a plurality of dynamic value parameters that appear in said display, and wherein each of said plurality of dynamic value parameters is associated with one of said plurality of combination indicators, and wherein each of said dynamic value parameters is a function of said "Probability and "Will Pay" information and a quantitative measure of the likelihood that the combination with which said dynamic value parameter is associated will yield a return on the wager of said player that is greater than the cost of said wager and is calculated from said temporally-updated information provided by said tote board.

2. The user interface as recited in claim 1, wherein:

each of said dynamic value parameters is a function of said tote board provided, temporally-updated odds for each of the contestants in one of said possible winning combinations and the predicted payout for said combination.

3. The user interface as recited in claim 1, further comprising:

a plurality of dynamic payouts that appear in said display, and wherein each of said dynamic payouts is associated with one of said plurality of combination indicators, and wherein each of said dynamic payouts is the temporally-updated, predicted payout for said associated combination that is provide by said tote board.

4. The user interface as recited in claim 1, further comprising:

a plurality of dynamic probabilities that appear in said display, and wherein each of said dynamic probabilities is associated with one of said plurality of combination indicators, and wherein each of said dynamic probabilities is a function of said tote board provided, temporally-updated odds for each of the contestants in said associated combination indicator.

5. The user interface as recited in claim 1, further comprising:

a filter mechanism that appears in said display and is configured so that said filter mechanism can be set to identify from among said plurality of combination indicators those combination indicators that have an associated parameter chosen from the group of a dynamic payout, a dynamic probability and a dynamic value, and wherein said chosen, associated parameter lies within a prescribed range of numbers.

6. The user interface as recited in claim 1, further comprising:

a summary portion that appears in said display and enables said player to see said tote board information for said win wagers placed on each of said plurality of contestants in said upcoming contest.

7. The user interface as recited in claim 2, further comprising:

a summary portion that appears in said display and enables said player to see said tote board information for said win wagers placed on each of said plurality of contestants in said upcoming contest.

8. A method of utilizing the display of a parimutuel wagering device to enable a player to place a combination wager of the type that requires said player to pick a specified combination of contestants in an upcoming contest and where a tote board is used to record the wagers of all players who place one of said combination wagers on said upcoming contest and to provide temporally-updated information regarding said wagers, including "Will Pay" and "Probability" information, said method comprising the steps of:

providing a plurality of combination indicators that appear in said display, and wherein each of said plurality of combination indicators represents one of the possible winning combinations of said wager, providing a plurality of dynamic value parameters that appear in said display, and wherein each of said plurality of dynamic value parameters is associated with one of said plurality of combination indicators, and wherein each of said dynamic value parameters is a function of said "Probability and "Will Pay" information and a quantitative measure of the likelihood that the combination with which said dynamic value parameter is associated will yield a return on the wager of said player that is greater than the cost of said wager and is calculated from said temporally-updated information provided by said tote board.

9. The method as recited in claim 8, wherein:

each of said dynamic value parameters is a function of said tote board provided, temporally-updated odds for each of the contestants in one of said possible winning combinations and the predicted payout for said combination.

10. The method as recited in claim 8, further comprising the step of:

providing a plurality of dynamic payouts that appear in said display, and wherein each of said dynamic payouts is associated with one of said plurality of combination indicators, and wherein each of said dynamic payouts is the temporally-updated, predicted payout for said associated combination that is provide by said tote board.

11. The method as recited in claim 8, further comprising the step of:

providing a plurality of dynamic probabilities that appear in said display, and wherein each of said dynamic probabilities is associated with one of said plurality of combination indicators, and wherein each of said dynamic probabilities is a function of said tote board provided, temporally-updated odds for each of the contestants in said associated combination indicator.

12. The method as recited in claim 8, further comprising the step of:

providing a filter mechanism that appears in said display and is configured so that said filter mechanism can be set to identify from among said plurality of combination indicators those combination indicators that have an associated parameter chosen from the group of a dynamic payout, a dynamic probability and a dynamic value, and wherein said chosen, associated parameter lies within a prescribed range of numbers.

13. The method as recited in claim 8, further comprising the step of:

providing a summary portion that appears in said display and enables said player to see said tote board information for said win wagers placed on each of said plurality of contestants in said upcoming contest.

14. The method as recited in claim 9, further comprising the step of:

providing a summary portion that appears in said display and enables said player to see said tote board information for said win wagers placed on each of said plurality of contestants in said upcoming contest.

15. A non-transitory, computer readable medium having program code recorded thereon for execution on a parimutuel wagering device, having a display, to enable a player to place a combination wager of the type that requires said player to pick a specified combination of contestants in an upcoming contest and where a tote board is used to record the wagers of all players who place one of said combination wagers on said upcoming contest and to provide temporally-updated information regarding said wagers, including "Will Pay" and "Probability" information, said program code causing said parimutuel wagering device to perform the following method steps:

providing a plurality of combination indicators that appear in said display, and wherein each of said plurality of combination indicators represents one of the possible winning combinations of said wager, providing a plurality of dynamic value parameters that appear in said display, and wherein each of said plurality of dynamic value parameters is associated with one of said plurality of combination indicators, and wherein each of said dynamic value parameters is a function of said "Probability and "Will Pay" information and a quantitative measure of the likelihood that the combination with which said dynamic value parameter is associated will yield a return on the wager of said player that is greater than the cost of said wager and is calculated from said temporally-updated information provided by said tote board.

16. The non-transitory, computer readable medium having program code recorded thereon as recited in claim 15, wherein:

each of said dynamic value parameters is a function of said tote board provided, temporally-updated odds for each of the contestants in one of said possible winning combinations and the predicted payout for said combination.

17. The non-transitory, computer readable medium having program code recorded thereon as recited in claim 15, further comprising the step of:

providing a plurality of dynamic payouts that appear in said display, and wherein each of said dynamic payouts is associated with one of said plurality of combination indicators, and wherein each of said dynamic payouts is the temporally-updated, predicted payout for said associated combination that is provide by said tote board.

18. The non-transitory, computer readable medium having program code recorded thereon as recited in claim 15, further comprising the step of:

providing a plurality of dynamic probabilities that appear in said display, and wherein each of said dynamic probabilities is associated with one of said plurality of combination indicators, and wherein each of said dynamic probabilities is a function of said tote board provided, temporally-updated odds for each of the contestants in said associated combination indicator.

19. The non-transitory, computer readable medium having program code recorded thereon as recited in claim 15, further comprising the step of:

providing a filter mechanism that appears in said display and is configured so that said filter mechanism can be set to identify from among said plurality of combination indicators those combination indicators that have an associated parameter chosen from the group of a dynamic payout, a dynamic probability and a dynamic value, and wherein said chosen, associated parameter lies within a prescribed range of numbers.

20. The non-transitory, computer readable medium having program code recorded thereon as recited in claim 15, further comprising the step of:

providing a summary portion that appears in said display and enables said player to see said tote board information for said win wagers placed on each of said plurality of contestants in said upcoming contest.

* * * * *